US009631816B2

(12) United States Patent
Lum et al.

(10) Patent No.: US 9,631,816 B2
(45) Date of Patent: Apr. 25, 2017

(54) BUNDLED TUBE FUEL NOZZLE

(71) Applicant: General Electric Company, Schenectady, NY (US)

(72) Inventors: Kassy Moy Lum, Greenville, SC (US); David William Cihlar, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 238 days.

(21) Appl. No.: 14/554,539

(22) Filed: Nov. 26, 2014

(65) Prior Publication Data

US 2016/0146469 A1 May 26, 2016

(51) Int. Cl.
*F23R 3/28* (2006.01)

(52) U.S. Cl.
CPC ..... *F23R 3/286* (2013.01)

(58) Field of Classification Search
None
See application file for complete search history.

(56) References Cited

U.S. PATENT DOCUMENTS

| | | | | |
|---|---|---|---|---|
| 4,117,302 | A | 9/1978 | Earle et al. | |
| 2010/0139280 | A1* | 6/2010 | Lacy | F23D 14/82 60/737 |
| 2012/0180487 | A1* | 7/2012 | Uhm | F23D 14/62 60/737 |
| 2013/0104556 | A1 | 5/2013 | Uhm et al. | |
| 2013/0186092 | A1 | 7/2013 | Bathina et al. | |
| 2014/0109587 | A1 | 4/2014 | Crothers et al. | |
| 2016/0178206 | A1* | 6/2016 | Yoshino | F23R 3/32 60/738 |

* cited by examiner

*Primary Examiner* — Pascal M Bui Pho
*Assistant Examiner* — Edwin Kang
(74) *Attorney, Agent, or Firm* — Dority & Manning, PA

(57) ABSTRACT

A bundled tube fuel nozzle includes a fuel distribution body. The fuel distribution body includes a substantially flat aft wall having an inner surface axially spaced from an outer surface, a fuel stem collar axially spaced from the inner surface of the aft wall and a contoured forward wall that extends between the fuel stem collar and the aft wall. The contoured forward wall and the aft wall define a fuel plenum within the fuel distribution body. The bundled tube fuel nozzle further includes a plurality of injector tubes that are in fluid communication with the fuel plenum. Each injector tube extends from the contoured forward wall to the aft wall within the fuel distribution body and defines a premix passage through the contoured forward, the fuel plenum and the aft wall.

17 Claims, 5 Drawing Sheets

BUNDLED TUBE FUEL NOZZLE

FIELD OF THE INVENTION

The present invention generally involves a combustor having a bundled tube fuel nozzle. More specifically, the invention relates to a fuel distribution body for a bundled tube fuel nozzle which is configured to mitigate combustion dynamics within the combustor.

BACKGROUND OF THE INVENTION

Combustors are commonly used in industrial and commercial operations to ignite fuel to produce combustion gases having a high temperature and pressure. For example, gas turbines and other turbo-machines typically include one or more combustors to generate power or thrust. A typical gas turbine used to generate electrical power includes an axial compressor at the front, multiple combustors around the middle, and a turbine at the rear. Ambient air enters the compressor as a working fluid, and the compressor progressively imparts kinetic energy to the working fluid to produce a compressed working fluid at a highly energized state.

The compressed working fluid exits the compressor and flows through one or more fuel nozzles and/or tubes in the combustors where the compressed working fluid mixes with fuel before igniting to generate combustion gases having a high temperature and pressure. In particular configurations, each combustor includes multiple bundled tube or micro-mixer type fuel nozzles. The multiple bundled tube or micro-mixer type fuel nozzles are configured to allow premixing of fuel and working fluid (i.e. air) upstream from a combustion chamber prior to combustion. The combustion gases flow to the turbine where they expand to produce work. For example, expansion of the combustion gases in the turbine may rotate a shaft connected to a generator to produce electricity.

At particular operating conditions, some combustors may produce combustion instabilities that result from an interaction or coupling of the combustion process or flame dynamics with one or more acoustic resonant frequencies of the combustor. For example, one mechanism of combustion instabilities may occur when the acoustic pressure pulsations cause a mass flow fluctuation at a fuel port which then results in a fuel-air ratio fluctuation in the flame. When the resulting fuel/air ratio fluctuation and the acoustic pressure pulsations have a certain phase behavior (e.g., in-phase or approximately in-phase), a self-excited feedback loop results. This mechanism, and the resulting magnitude of the combustion dynamics, depends on the delay time between the injection of the fuel and the time when it reaches the flame zone, known in the art as "convective time" (Tau). Generally, there is an inverse relationship between convective time and frequency: that is, as the convective time increases, the frequency of the combustion instabilities decreases; and when the convective time decreases, the frequency of the combustion instabilities increases. In the case of a bundled tube fuel nozzle, convective time is generally measured as the time it takes for the fuel and air to reach an outlet of the tube as determined from a point within each tube where the fuel is injected.

It has been observed that, in some instances, combustion dynamics may reduce the useful life of one or more combustor and/or downstream components. For example, the combustion dynamics may produce pressure pulses inside the fuel nozzles and/or combustion chambers that may adversely affect the high cycle fatigue life of these components, the stability of the combustion flame, the design margins for flame holding, and/or undesirable emissions. Alternately, or in addition, combustion dynamics at specific frequencies and with sufficient amplitudes, that are in-phase and coherent, may produce undesirable sympathetic vibrations in the turbine and/or other downstream components.

Current systems and/or methodologies for mitigating combustion dynamics include damping systems which are designed to mitigate one particular frequency and/or a limited frequency range. Other systems related to bundled tube fuel nozzles include varying the length of the individual tubes downstream from a fuel plenum portion of the bundled tube fuel nozzle, thus effecting the convection time to mitigate or prevent certain frequencies from occurring within the combustor. However, current systems are generally complex and may be costly to manufacture and maintain. Accordingly, an improved bundled tube fuel nozzle that is configured to mitigate combustion dynamics within a combustor would be useful.

BRIEF DESCRIPTION OF THE INVENTION

Aspects and advantages of the invention are set forth below in the following description, or may be obvious from the description, or may be learned through practice of the invention.

One embodiment of the present invention is a bundled tube fuel nozzle. The bundled tube fuel nozzle includes a fuel distribution body. The fuel distribution body includes and/or defines a substantially flat aft wall having an inner surface axially spaced from an outer surface, a fuel stem collar axially spaced from the inner surface of the aft wall and a contoured forward wall that extends between the fuel stem collar and the aft wall. The contoured forward wall and the aft wall define a fuel plenum within the fuel distribution body. The bundled tube fuel nozzle further includes a plurality of injector tubes that are in fluid communication with the fuel plenum. Each injector tube extends from the contoured forward wall to the aft wall within the fuel distribution body and defines a premix passage through the contoured forward, the fuel plenum and the aft wall.

Another embodiment of the present disclosure is a bundled tube fuel nozzle. The bundled tube fuel nozzle includes a fuel distribution body having and/or defining a substantially flat aft wall that includes an inner surface that is axially spaced from an outer surface. A perimeter wall surrounds an outer perimeter of the aft wall and a fuel stem collar is axially spaced from the inner surface of the aft wall. A contoured forward wall extends between the fuel stem collar and the perimeter wall. The contoured forward wall, the perimeter wall and the aft wall define a fuel plenum within the fuel distribution body. A plurality of injector tubes extends axially from the contoured forward wall to the aft wall. Each injector tube terminates at or along an outer surface of the contoured forward wall. Each injector tube defines a premix passage through the contoured forward, the fuel plenum and the aft wall. Each injector tube also includes at least one fuel port that provides for fluid communication between the fuel plenum and the premix passage.

The present invention also includes a combustor. The combustor includes an end cover that is coupled to an outer casing and a bundled tube fuel nozzle. The bundled tube fuel nozzle includes a fuel distribution body that is fluidly coupled to the end cover via a fuel stem, and a plurality of tubes that are arranged parallel in a bundle. Each tube includes an inlet end axially separated from an outlet end. The fuel distribution body includes a substantially flat aft wall having an inner surface that is axially spaced from an outer surface, a fuel stem collar that is axially spaced from the inner surface of the aft wall and that is coupled to the fuel stem collar and a contoured forward wall that extends between the fuel stem collar and the aft wall. The contoured forward wall and the aft wall at least partially define a fuel plenum within the fuel distribution body. The fuel distribution body further includes a plurality of injector tubes that are in fluid communication with the fuel plenum. Each injector tube extends from the contoured forward wall to the aft wall and defines a premix passage through the contoured forward, the fuel plenum and the aft wall. Each injector tube includes a fuel port that provides for fluid communication between the fuel plenum and the premix passage. Each tube of the plurality of tubes extends downstream from a corresponding premix passage of the fuel distribution body.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
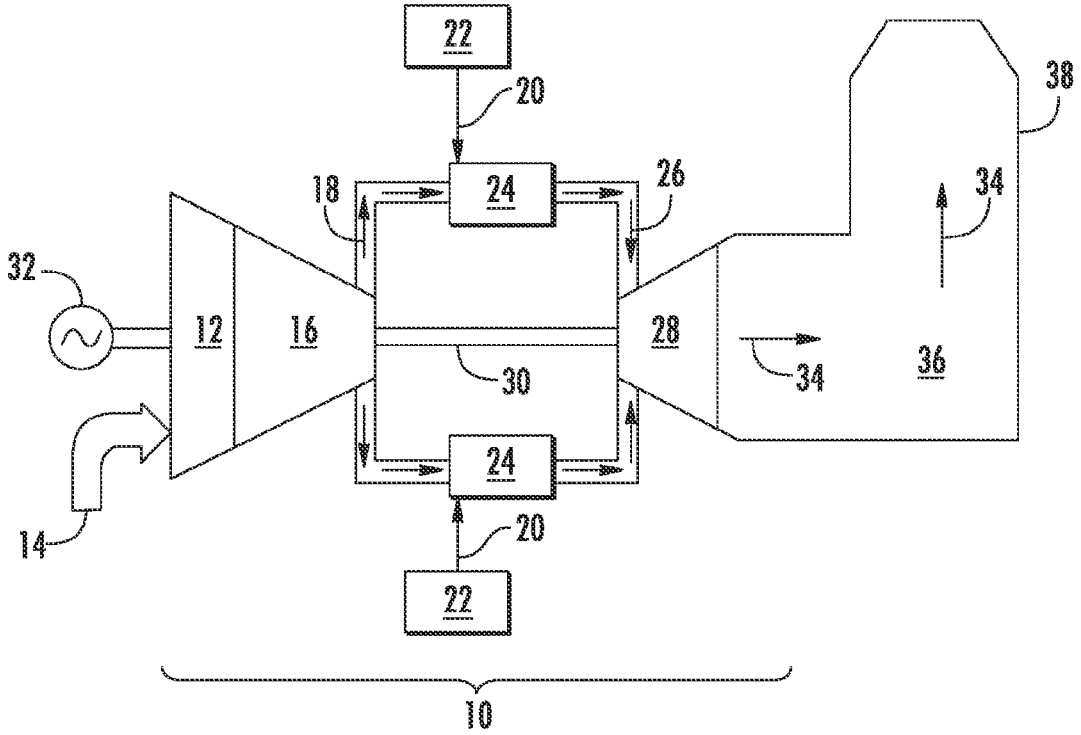
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a bundled tube fuel nozzle for a land based power generating gas turbine combustor for purposes of illustration, one of ordinary skill in the art will readily appreciate that embodiments of the present invention may be applied to any style or type of combustor of a turbomachine and are not limited to combustors or combustion systems for land based power generating gas turbines unless specifically recited in the claims.

The invention as provided herein incorporates varying tube lengths within a contoured fuel distribution body portion of a bundled tube fuel nozzle to allow for a multi-tau approach to mitigating combustion dynamics. The fuel distribution body may be retrofitted on existing bundled tube fuel nozzles with zero to minimal modifications required. A variation in injector tube height allows for fuel ports to be located in either the same plane or in different planes within the fuel plenum with respect to an axial centerline of the fuel distribution body. The contoured forward wall portion of the fuel distribution body requires less material than convention fuel distribution bodies, thus overall weight for the bundled tube fuel nozzle is reduced, thereby reducing cost and increasing robustness of the assembled bundled tube fuel nozzle. In addition, variable injector tube lengths within the fuel distribution body may mitigate and/or prevent potential combustion dynamics issues. In addition, varying fuel port locations along the injector tubes within the fuel plenum may provide a desired convection time, thus mitigating combustion dynamics using a non-uniform, multi tau dynamic approach. In addition, the contoured forward wall of the fuel distribution body allows for a build angle of 35 degrees or more as opposed to a conventional flat face front wall, which requires cones or fillets to be built at the injector tube forward wall interface for a flat forward face, thus adding cost and weight.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
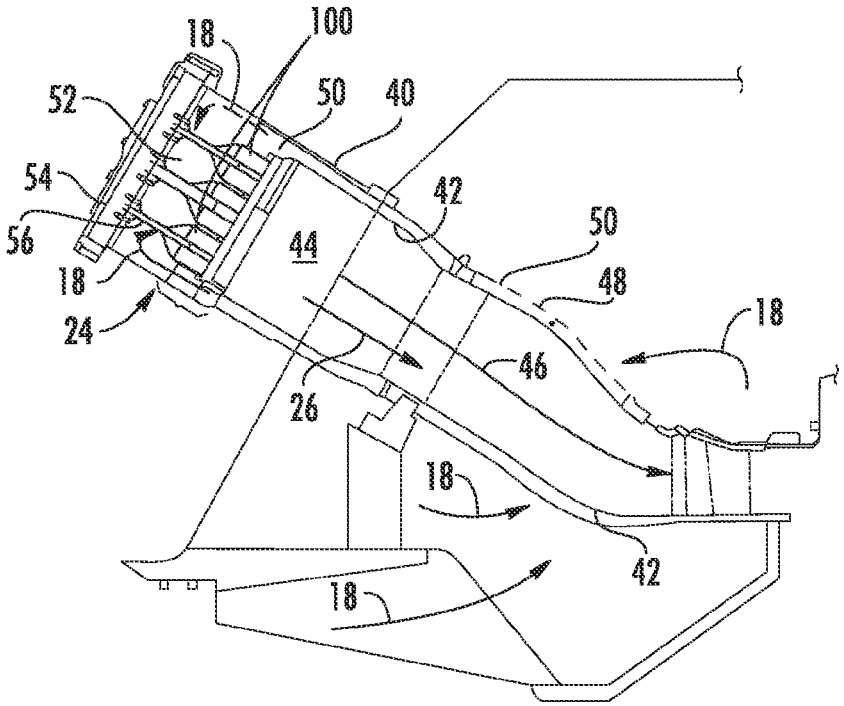
FIG. 2 is a side perspective view of an exemplary combustor as may incorporate various embodiments of the present invention.
Figure 3:
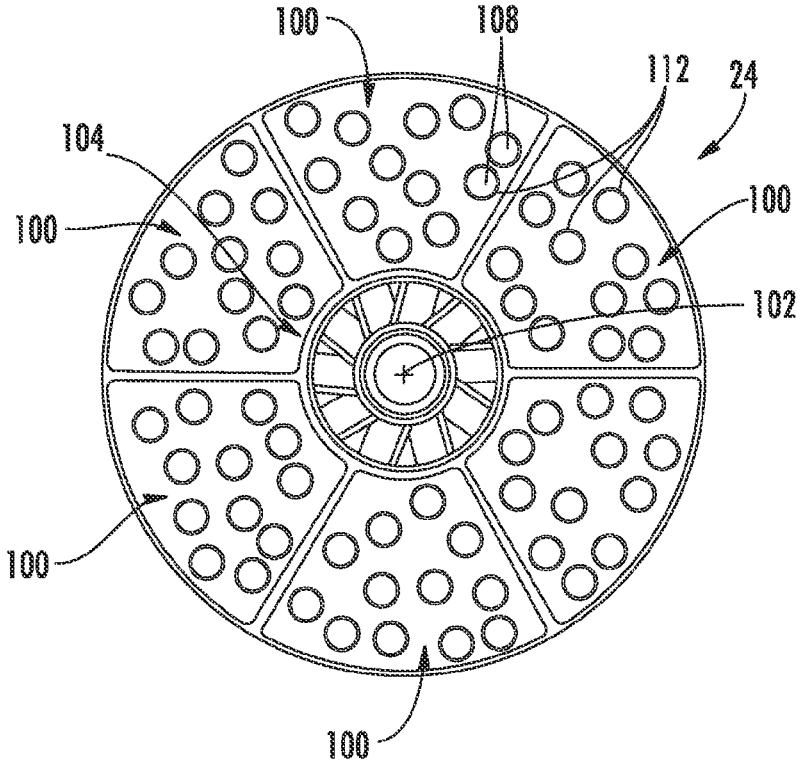
FIG. 3 is an upstream view of a portion of the combustor as shown in FIG. 2 according to one embodiment of the present invention.

The combustor 24 may be any type of combustor known in the art, and the present invention is not limited to any particular combustor design unless specifically recited in the claims. For example, the combustor 24 may be a can-annular or an annular combustor. FIG. 2 provides a perspective side view of a portion of an exemplary combustor 24 as may be incorporated in the gas turbine 10 shown in FIG. 1 and as may incorporate one or more embodiments of the present invention. FIG. 3 provides an upstream top view of a portion of the combustor according to one embodiment.

In an exemplary embodiment, as shown in FIG. 2, the combustor 24 is at least partially surrounded by an outer casing 40. The outer casing 40 is in fluid communication with a compressed air source such as the compressor 16. The combustor may include one or more liners 42 such as a combustion liner and/or a transition duct that at least partially define a combustion chamber 44 within the outer casing. The liner(s) 42 may also at least partially define a hot gas path 46 for directing the combustion gases 26 into the turbine 28. In particular configurations, one or more outer sleeves 48 such as a flow sleeve or impingement sleeve may at least partially surround the liner(s) 44. The outer sleeve(s) 48 is radially spaced from the liner(s) 42 so as to define an annular flow path 50 for directing a portion of the compressed air 18 towards a head end portion 52 of the combustor 24. The head end portion 52 may be at least partially defined by an end cover 54 that is fixedly connected to the outer casing 40.

In various embodiments, the combustor 24 includes a plurality of bundled tube fuel nozzles 100 disposed within or encased within the outer casing 40. As shown in FIGS. 2 and 3, the plurality of bundled tube fuel nozzles 100 may be annularly arranged around a common axial centerline 102. In various embodiments, each bundled tube fuel nozzle 100 is connected to the end cover 54 via a fuel stem 56. The fuel stem 56 is in fluid communication with a fuel source (not shown) such as a fuel skid and/or the end cover 54.

In particular embodiments, as shown in FIG. 3, the bundled tube fuel nozzles 100 may be annularly arranged around a center fuel nozzle 104 which is substantially coaxially aligned with centerline 102. In particular configurations, the center fuel nozzle 104 may be a swozzle or premix fuel nozzle as shown in FIG. 3 or may be a bundled tube or micro-mixer type fuel nozzle.

Figure 4:
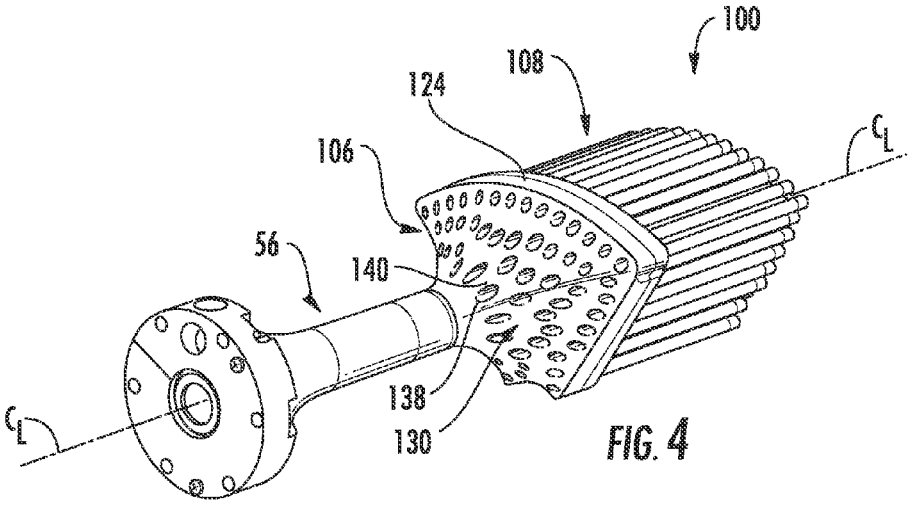
FIG. 4 is a downstream perspective view of an exemplary bundled tube fuel nozzle according to various embodiments of the present invention.
Figure 5:
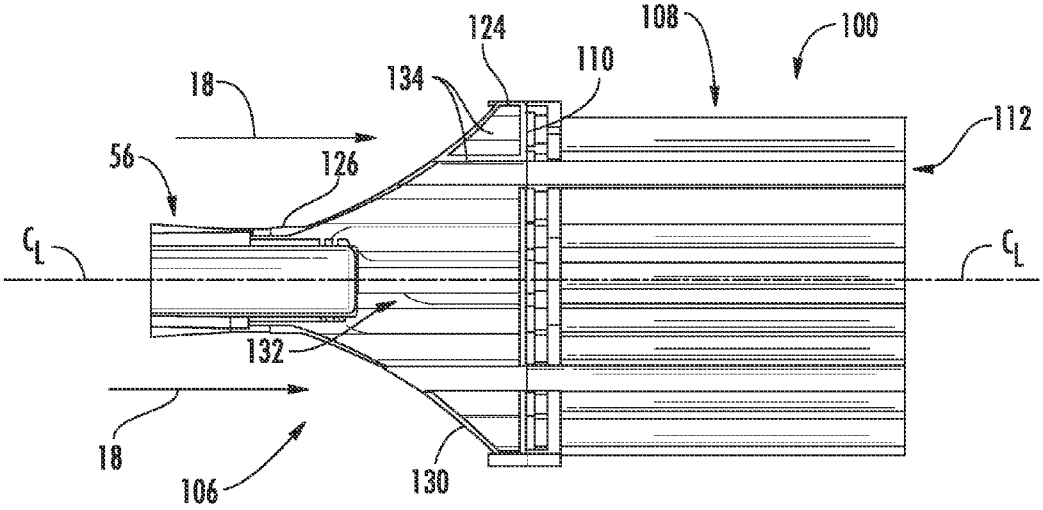
FIG. 5 is an enlarged cross sectioned side view of the bundled tube fuel nozzle as shown in FIG. 4, according to at least one embodiment.

FIG. 4 provides a downstream perspective view of the exemplary bundled tube fuel nozzle 100 including fuel stem 56 according to various embodiments of the present invention. FIG. 5 provides an enlarged cross sectioned side view of the bundled tube fuel nozzle 100 as shown in FIG. 4, according to at least one embodiment. In particular embodiments, as shown in FIGS. 4 and 5, the bundled tube fuel nozzle 100 includes a fuel distribution body 106 fluidly connected to the fuel stem 56. In particular embodiments, the bundled tube fuel nozzle 100 includes a plurality of tubes 108 arranged in a bundle. Each tube 108 of the plurality of tubes 108 extends parallel to one another and downstream from the fuel distribution body 106.

As shown in FIG. 5, each tube 108 includes an inlet end 110 axially separated from an outlet end 112. As shown in FIG. 3, the outlet ends 112 of each tube 108 may extend through or at least partially through an end cap or plate 114. When installed in the combustor 24, as shown in FIG. 2, the fuel stem 56 extends axially downstream from the end cover 54, the fuel distribution body 106 extends axially downstream from the fuel stem 56 and the plurality of tubes 108 extends downstream from the fuel distribution body 106 as shown in FIG. 4. The outlet ends 112 of the tubes 108 generally terminate upstream from and/or adjacent to the combustion chamber 44 (FIG. 2).

Figure 6:
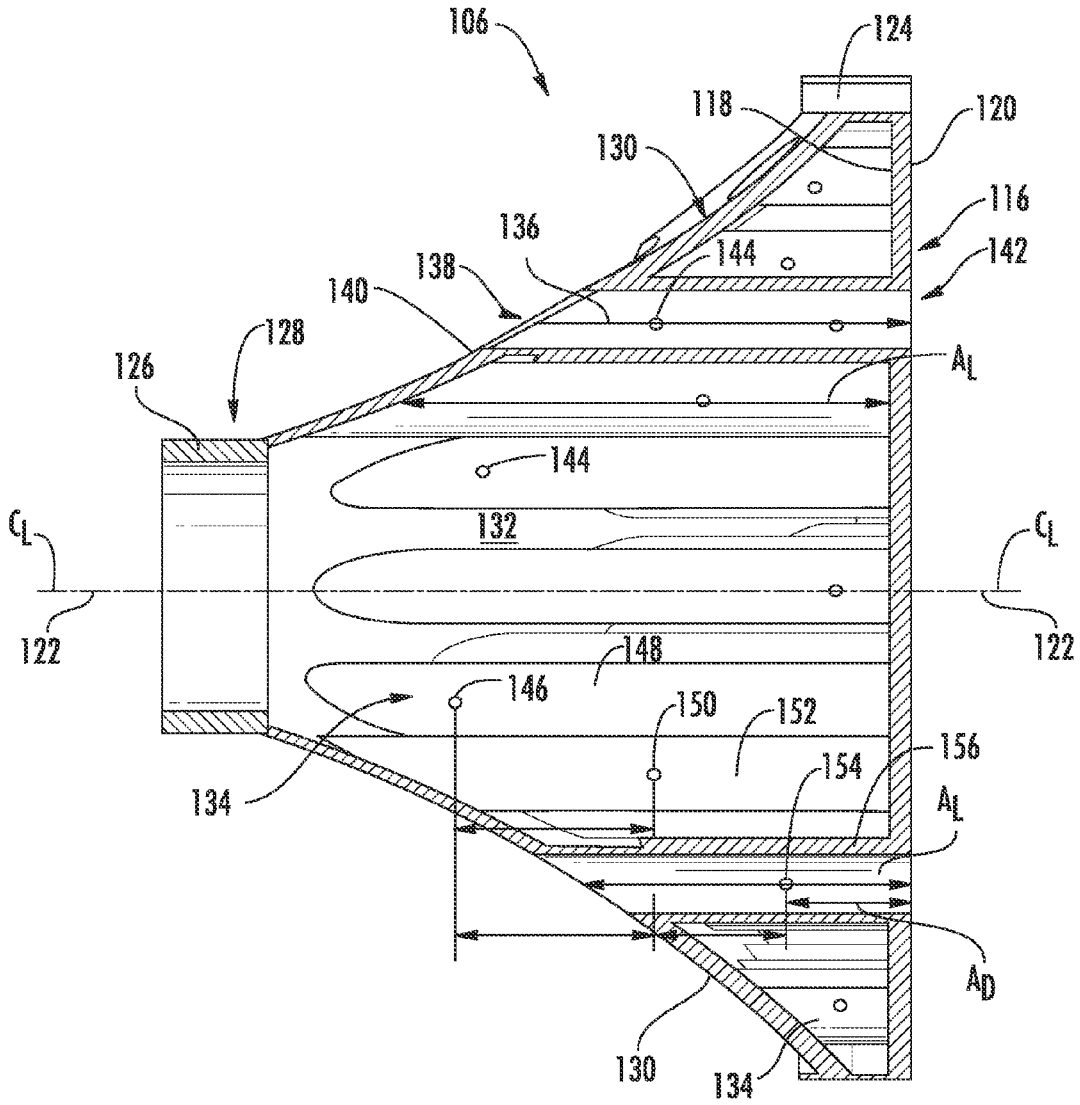
FIG. 6 is a cross sectioned side view of the fuel distribution body as shown in FIGS. 4 and 5 according to various embodiments of the present invention.
Figure 7:
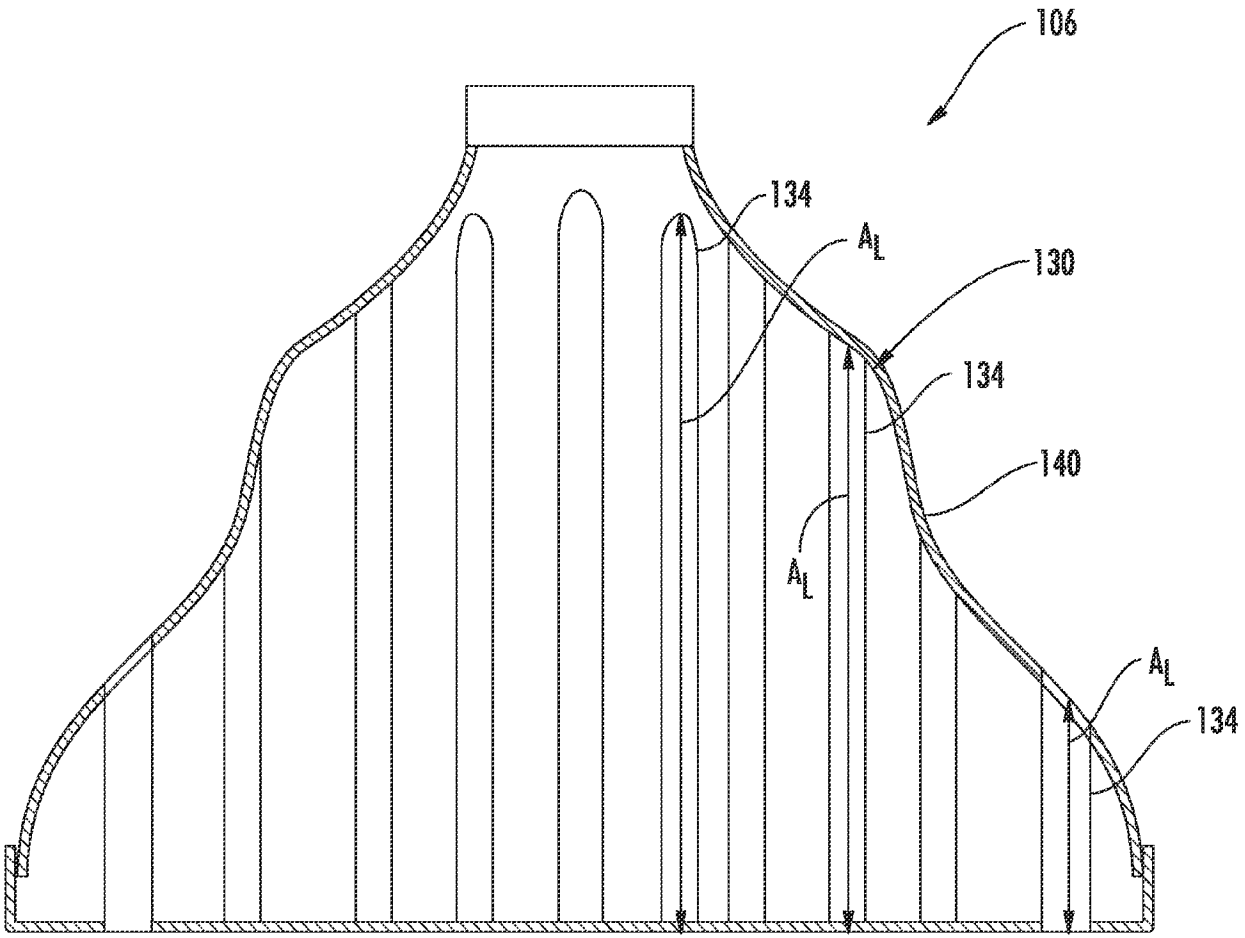
FIG. 7 is a cross sectioned side view of an exemplary fuel distribution body according to one embodiment of the present invention.

FIG. 6 provides a cross sectioned side view of the fuel distribution body 106 as shown in FIGS. 4 and 5 according to various embodiments of the present invention. FIG. 7 is a cross sectioned side view of the fuel distribution body 106 as shown in FIGS. 4 and 5 according to another embodiment of the present invention. In various embodiments, as shown in FIG. 6, the fuel distribution body 106 includes a substantially flat aft wall 116. The aft wall 116 includes and/or defines an inner side or surface 118 that is axially spaced from an outer side or surface 120 with respect to an axial centerline 122 of the fuel distribution body 106. In particular embodiments, as shown in FIGS. 4 and 6, the fuel distribution body 106 includes and/or defines a perimeter wall 124 that surrounds an outer perimeter of the aft wall 116.

In various embodiments, as shown in FIG. 6, the fuel distribution body 106 further includes and/or defines a fuel stem collar 126 that is axially spaced from the inner surface 118 of the aft wall 116 with respect to centerline 122. The fuel stem collar 126 is generally positioned at an upstream end or portion 128 of the fuel distribution body 106. In particular embodiments, as shown in FIG. 5, the fuel stem 56 is connected or coupled to the fuel distribution body 106 via the fuel stem collar 126.

In various embodiments, as shown in FIGS. 4 through 6, the fuel distribution body 106 includes and/or defines contoured forward wall 130. As used herein, the term "contoured" includes a surface or wall that is not substantially flat such as but not limited to an arcuate, swept or undulating surface or wall. As shown most clearly in FIGS. 5 and 6, the contoured forward wall 130 extends between the fuel stem collar 126 and the aft wall 116. In particular embodiments, the contoured forward wall 130 extends between the fuel stem collar 126 and the perimeter wall 124. Although the perimeter wall 124 is shown in the various figures, the invention should not be limited to a fuel distribution body 106 having a perimeter wall 124 unless specifically recited in the claims. For example, the contoured forward wall 130 may extend from the fuel stem collar 126 to the aft wall 116. In particular embodiments as shown in FIG. 6, the contoured forward wall 130 diverges radially outwardly from the fuel stem collar 126 towards the aft wall 116 with respect to centerline 122. In particular embodiments, as shown in FIGS. 4 and 7, the contoured forward wall 130 may undulate or rise and fall circumferentially (FIG. 4) and/or axially (FIG. 7) about the fuel distribution body 106.

As shown in FIGS. 5 and 6, the contoured forward wall 130 and the aft wall 116 at least partially define a fuel plenum 132 within the fuel distribution body 106. In particular embodiments, the contoured forward wall 130, the perimeter wall 124 and the aft wall 116 at least partially define the fuel plenum 132 within the fuel distribution body 106.

In various embodiments, as shown in FIGS. 5 and 6, the fuel distribution body 106 includes and/or defines a plurality of injector tubes 134 in fluid communication with the fuel plenum 132. Each injector tube 134 extends axially from the aft wall 116 and/or the inner surface 118 of the aft wall 116 towards the fuel stem collar 126 through the fuel plenum 132. Each injector tube 134 may terminate at and/or blend into the contoured forward wall 130. A desired or required axial length $A_L$ of each individual injector tube 134 of the plurality of injector tubes 134 generally determines the shape or contour of the contoured forward wall 130.

Although the injector tubes 134 in FIG. 6 are arranged in a pattern such that the injector tubes 134 increase in axial length $A_L$ from the injector tubes 134 closest to the outer perimeter or perimeter wall 124 of the fuel distribution body 106 radially inward towards the axial centerline 122, it fully contemplated herein that the injector tubes 134 may be arranged in any pattern with varying axial lengths $A_L$ of the injector tubes 134. For example, at least a portion of the injector tubes 134 closest to the centerline 122 may have an axial length $A_L$ that that is less than injector tubes 134 that are spaced radially outwardly. As a result, the contoured forward wall 130 would have a different profile or shape which corresponds to the axial lengths $A_L$ of the various injector tubes 134.

As shown in FIG. 6, each injector tube 134 at least partially defines a premix passage 136 that provides for fluid communication through the contoured forward wall 130, the fuel plenum 132 and the aft wall 116. For example, in various embodiments, as shown in FIGS. 4 and 6, an inlet portion 138 of each premix passage 136 is defined along an outer surface 140 of the contoured forward wall 130. The inlet portion 138 is flush or substantially flush with the outer surface 140. As a result, the inlet portion is generally oblong shaped.

As shown in FIG. 6, an outlet portion 142 of each premix passage 136 is defined along the outer surface 120 of the aft wall 116. In particular embodiments, as shown in FIG. 5, the inlet ends or portions 110 of each tube 108 of the plurality of tubes 108 is concentrically aligned with a corresponding injector tube 134 premix passage 136 at the outlet portion 142. Each tube 108 of the plurality of tubes 108 is in fluid communication with the corresponding premix passage 136.

As shown in FIG. 6, at least a portion of the injector tubes 134 may include one or more fuel ports 144. The fuel port(s) 144 are generally defined along the corresponding injector tube 134 within the fuel plenum 132 and each fuel port 144 may define a flow path between the fuel plenum 132 and the premix passage 136. In particular embodiments, the fuel ports 144 of various tubes are axially offset from one another with respect to the centerline 122. For example, in one embodiment, a first fuel port 146 of a first injector tube 148 of the plurality of injector tubes 134 is axially offset from a second fuel port 150 of a second injector tube 152 of the plurality of injector tubes 134 with respect to the centerline 122 where the first and second fuel ports 146, 150 provide for fluid communication between the fuel plenum 132 and the first and second injector tubes 148, 152 respectfully. In one embodiment, a third fuel port 154 of a third injector tube 156 of the plurality of injector tubes 134 is axially offset from at least one of the first and second fuel ports 146, 150. In particular embodiments, the exact axial location and/or offset distance of the various fuel port(s) 144 is determined based on a desired convection time and/or a particular frequency to be mitigated or eliminated within the combustor 24.

In operation, a portion of the compressed air 18 flows towards the head end 52 and/or the end cover 54 where it reverses direction and flows into the inlet portions 140 of each premix passage 136. Fuel is provided to the fuel plenum 132 via the fuel stem 56. The fuel is injected from the fuel plenum 132 into each of the premix passages 136 via the fuel port(s) 144 of each corresponding injector tube 134. The fuel premixes with the compressed air 18 within each premix passage 136 as it travels an axial distance $A_D$ with respect to centerline 122 towards the outlet portion 142 of each premix passage 136. The fuel and air mixture exits the outlet portion of each premix passage 136 and travels down the corresponding tube 108 of the plurality of tubes 108 before exiting into the combustion chamber 44 where it is burned to produce the combustion gases 26.

The time between when the fuel is injected into the individual premix passages 136 and the time when it reaches the combustion chamber is conventionally known in the art as "convective time" and/or (Tau). It has been shown that the mechanisms which result in combustion instabilities and the resulting magnitude of the combustion dynamics depend, at least in part, on the convective time. Generally, there is an inverse relationship between convective time and frequency. For example, as the convective time increases, the frequency of the combustion instabilities decreases, and when the convective time decreases, the frequency of the combustion instabilities increases. It has been shown that combustion dynamics, in some cases multi frequencies, may be affected or mitigated by varying convection time. This is known as a multi-tau dynamic approach to mitigating combustion dynamics.

In particular embodiments, axial length $A_L$ of each injector tube 134 may be determined or selected to effect convection time of the fuel and air flowing through the bundled tube fuel nozzle 100, thus mitigating potential effects of combustion dynamics via a multi-tau dynamic approach. For example, a first portion of the injector tubes 134 may have longer axial lengths $A_L$ than a second, third, fourth or greater portion of the injector tubes 134. In addition or in the alternative, the axial offset between the fuel ports 144 of the various injector tubes 134 may be adjusted or determined to increase and/or decrease the convection time of the fuel and air flowing through the bundled tube fuel nozzle 100, thus eliminating or reducing the potentially harmful effects of multi-frequency combustion dynamics via a multi tau dynamic approach.

In order to reduce costs, weight and to provide the intricately formed contoured forward wall 130 and/or the injector tubes 134 of varying axial lengths $A_L$ and/or the exact axial positioning of the fuel port(s) 144 of the fuel distribution body 106 as described, the fuel distribution body 106 may be manufactured or formed, at least in part or entirely, via one or more additive manufacturing techniques or processes, thus providing for greater accuracy and/or more intricate details within the fuel distribution body 106 than previously producible by conventional manufacturing processes. As used herein, the terms "additively manufactured" or "additive manufacturing techniques or processes" include but are not limited to various known 3D printing manufacturing methods such as Extrusion Deposition, Wire, Granular Materials Binding, Powder Bed and Inkjet Head 3D Printing, Lamination and Photo-polymerization.

In one embodiment, the additive manufacturing process of Direct Metal Laser Sintering DMLS is a preferred method of manufacturing the fuel distribution body 106 described herein. DMLS is a known manufacturing process that fabricates metal components using three-dimensional information, for example a three-dimensional computer model of the fuel distribution body 106. The three-dimensional information is converted into a plurality of slices where each slice defines a cross section of the component for a predetermined height of the slice. The fuel distribution body 106 is then "built-up" slice by slice, or layer by layer, until finished.

Each layer of the fuel distribution body 106 is formed by fusing a metallic powder using a laser.

Although the methods of manufacturing the fuel distribution body 106 including the contoured forward wall 130 and/or the injector tubes 134 of varying axial lengths $A_L$ and/or the exact axial positioning of the fuel port(s) 144 have been described herein using DMLS as the preferred method, those skilled in the art of manufacturing will recognize that any other suitable rapid manufacturing methods using layer-by-layer construction or additive fabrication can also be used. These alternative rapid manufacturing methods include, but not limited to, Selective Laser Sintering (SLS), 3D printing, such as by inkjets and laserjets, Sterolithography (SLS), Direct Selective Laser Sintering (DSLS), Electron Beam Sintering (EBS), Electron Beam Melting (EBM), Laser Engineered Net Shaping (LENS), Laser Net Shape Manufacturing (LNSM) and Direct Metal Deposition (DMD).

The bundled tube fuel nozzle 100 provided herein for combustion dynamic mitigation has several technological benefits over existing combustion dynamic mitigation systems for combustors having bundled tube fuel nozzles. For example, the bundled tube fuel nozzle 100, particularly the fuel distribution body 106 provided herein, optimizes fuel volume, convective time, and tube length via a multi-tau approach utilizing the fuel distribution body 106 rather than by modifying components downstream from the fuel distribution body 106.

This configuration may also allow for a cost effective retrofit of existing bundled tube fuel nozzles to mitigate or tune combustion dynamics frequencies in existing combustors. For example, it is generally desirable to maintain a constant length of the tubes 108 of the plurality of tubes 108 that extend downstream of the fuel distribution body 106 because those tubes 108 are integrated into several other pieces of combustion hardware such as but not limited to the cap plate 114. However, by modifying the axial length $A_L$ of the injector tubes 134, the convection time may be increased or decreased as needed to address particular frequencies within the combustor without affecting an overall axial length of the bundled tube fuel nozzle 100.

In addition, the additive manufacturing process for forming the fuel distribution body 106 allows for a reduced part weight, reduced time and cost to build and a decreased volume of material due to non-uniformity, greater design flexibility. In addition, the bundled tube fuel nozzle provided herein allows for mitigation of both high and low frequency combustion dynamics. As a result, the potential adverse effects of combustion dynamics are decreased and the operability of the gas-turbine is increased.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A bundled tube fuel nozzle, comprising;

a fuel distribution body, the fuel distribution body comprising:

an aft wall having an inner surface axially spaced from an outer surface;

a fuel stem collar axially spaced from the inner surface of the aft wall;

a contoured forward wall that extends between the fuel stem collar and the aft wall, wherein the contoured forward wall undulates circumferentially between the fuel stem collar and the aft wall wherein the contoured forward wall and the aft wall define a fuel plenum within the fuel distribution body, wherein the fuel plenum undulates with the contoured forward wall; and a plurality of injector tubes in fluid communication with the fuel plenum, each injector tube extending from the contoured forward wall to the aft wall, each injector tube defining a premix passage through the contoured forward wall, the fuel plenum and the aft wall.

2. The bundled tube fuel nozzle as in claim 1, wherein the contoured forward wall diverges radially outwardly from the fuel stem collar to the aft wall with respect to an axial centerline of the bundled tube fuel nozzle.

3. The bundled tube fuel nozzle as in claim 1, where each injector tube includes a fuel port that provides for fluid communication between the fuel plenum and the premix passage.

4. The bundled tube fuel nozzle as in claim 1, wherein a first fuel port of a first injector tube of the plurality of injector tubes is axially offset from a second fuel port of a second injector tube of the plurality of injector tubes, wherein the first and second fuel ports provide for fluid communication between the fuel plenum and the first and second injector tubes of the plurality of injector tubes.

5. The bundled tube fuel nozzle as in claim 4, wherein a third fuel port of a third injector tube of the plurality of injector tubes is axially offset from at least one of the first and second fuel ports.

6. The bundled tube fuel nozzle as in claim 1, further comprising a fuel stem coupled at one end to the fuel stem collar, wherein the fuel stem is in fluid communication with a fuel source.

7. The bundled tube fuel nozzle as in claim 1, further comprising a plurality of tubes arranged in parallel in a bundle, each tube having an inlet end axially separated from an outlet end, wherein each tube is concentrically aligned with a corresponding premix passage, wherein each tube of the plurality of tubes is in fluid communication with the corresponding premix passage.

8. A bundled tube fuel nozzle, comprising;

a fuel distribution body, the fuel distribution body comprising:

an aft wall having an inner surface axially spaced from an outer surface;

a perimeter wall, wherein the contoured forward wall undulates circumferentially between the fuel stem collar and the aft wall, that surrounds an outer perimeter of the aft wall;

a fuel stem collar axially spaced from the inner surface of the aft wall;

a contoured forward wall that extends between the fuel stem collar and the perimeter wall, wherein the contoured forward wall, the perimeter wall and the aft wall define a fuel plenum within the fuel distribution body, wherein the fuel plenum undulates with the contoured forward wall; and a plurality of injector tubes extending axially from the contoured forward wall to the aft wall, each injector tube terminating at an outer surface of the contoured forward wall, each injector tube defining a premix passage through the contoured forward wall, the fuel plenum and the aft wall, wherein each injector tube includes a fuel port that provides for fluid communication between the fuel plenum and the premix passage.

9. The bundled tube fuel nozzle as in claim 8, wherein the contoured forward wall diverges radially outwardly from the fuel stem collar to the perimeter wall with respect to an axial centerline of the bundled tube fuel nozzle.

10. The bundled tube fuel nozzle as in claim 8, wherein a first fuel port of a first injector tube of the plurality of injector tubes is axially offset from a second fuel port of a second injector tube of the plurality of injector tubes.

11. The bundled tube fuel nozzle as in claim 8, further comprising a fuel stem coupled at one end to the fuel stem collar, wherein the fuel stem is in fluid communication with a fuel source.

12. The bundled tube fuel nozzle as in claim 8, further comprising a plurality of tubes arranged parallel in a bundle, each tube having an inlet end axially separated from an outlet end, wherein each tube is concentrically aligned with a corresponding premix passage.

13. The bundled tube fuel nozzle as in claim 12, wherein each tube of the plurality of tubes is in fluid communication with the corresponding premix passage of the plurality of premix passages of the fuel distribution body.

14. A combustor, comprising:

an end cover coupled to an outer casing; and a plurality of bundled tube fuel nozzles annularly arranged about a center fuel nozzle, each bundled tube fuel nozzle including a fuel distribution body fluidly coupled to the end cover via a fuel stem, wherein each fuel distribution body comprises:

an aft wall having an inner surface axially spaced from an outer surface;

a fuel stem collar axially spaced from the inner surface of the aft wall, wherein the fuel stem is coupled to the fuel stem collar;

a contoured forward wall that extends between the fuel stem collar and the aft wall, wherein the contoured forward wall undulates circumferentially between the fuel stem collar and the aft wall, wherein the contoured forward wall and the aft wall define a fuel plenum within the fuel distribution body, wherein the fuel plenum undulates with the contoured forward wall; and a plurality of injector tubes in fluid communication with the fuel plenum, each injector tube extending from the contoured forward wall to the aft wall, each injector tube defining a premix passage through the contoured forward wall, the fuel plenum and the aft wall, wherein each injector tube includes a fuel port that provides for fluid communication between the fuel plenum and the premix passage.

15. The combustor as in claim 14, wherein the contoured forward wall diverges radially outwardly from the fuel stem collar towards the aft wall with respect to an axial centerline of the bundled tube fuel nozzle.

16. The combustor as in claim 14, wherein a first fuel port of a first injector tube of the plurality of injector tubes is axially offset from a second fuel port of a second injector tube of the plurality of injector tubes.

17. The combustor as in claim 16, wherein a third fuel port of a third injector tube of the plurality of injector tubes is axially offset from at least one of the first and second fuel ports.

* * * * *